US006553676B1

(12) United States Patent
Carlson et al.

(10) Patent No.: US 6,553,676 B1
(45) Date of Patent: Apr. 29, 2003

(54) PROTRACTOR

(75) Inventors: Christopher Robert Carlson, Wausau, WI (US); Cory R. Boudreau, Madison, WI (US); David E. Barnard, Madison, WI (US); Ryan W. Rindy, Madison, WI (US); Sheldon Roberts, Sun Prairie, WI (US)

(73) Assignee: Alterra Holdings Corporation, Tigard, OR (US)

( * ) Notice: Subject to any disclaimer, the term of this patent is extended or adjusted under 35 U.S.C. 154(b) by 0 days.

(21) Appl. No.: 09/723,597

(22) Filed: Nov. 28, 2000

(51) Int. Cl.[7] ..... B43L 7/10
(52) U.S. Cl. ..... 33/424; 33/471; 33/495
(58) Field of Search ..... 33/424, 465, 495, 33/496, 1 N, 471, 534, 538

(56) References Cited

U.S. PATENT DOCUMENTS

| | | | | | |
|---|---|---|---|---|---|
| 207,950 | A | * | 9/1878 | Cook | 33/496 |
| 363,321 | A | * | 5/1887 | Douglas | 33/499 |
| 832,483 | A | * | 10/1906 | Johnson | 33/471 |
| 1,086,545 | A | * | 2/1914 | Meister et al. | 33/424 |
| 5,113,590 | A | * | 5/1992 | Shapiro et al. | 33/471 |
| 5,408,753 | A | | 4/1995 | Hong | 33/430 |
| 5,419,053 | A | | 5/1995 | Kathan | 33/417 |
| 5,426,859 | A | | 6/1995 | Concari et al. | 33/27.02 |
| 5,440,818 | A | | 8/1995 | Mailhot | 33/452 |
| D363,239 | S | | 10/1995 | Spirer et al. | D10/65 |
| 5,488,777 | A | | 2/1996 | Erdesky | 33/280 |
| 5,497,558 | A | | 3/1996 | Wagner | 33/27.03 |
| 5,501,019 | A | | 3/1996 | Concari et al. | 33/494 |
| 5,588,218 | A | | 12/1996 | Barry et al. | 33/471 |
| D398,865 | S | | 9/1998 | Dietterich et al. | D10/62 |
| D398,867 | S | | 9/1998 | Taylor | D10/65 |
| D402,217 | S | | 12/1998 | Taylor | D10/65 |
| 5,845,638 | A | | 12/1998 | Pretel et al. | 128/595 |
| 5,864,959 | A | | 2/1999 | Johansen et al. | 33/474 |
| 5,915,807 | A | | 6/1999 | Ilagan | 33/471 |
| D411,959 | S | | 7/1999 | Chan | D10/65 |
| 6,073,356 | A | | 6/2000 | Li | 33/391 |
| 6,073,532 | A | | 6/2000 | English | 83/875 |
| 6,105,268 | A | * | 8/2000 | Vaughn et al. | 33/471 |

OTHER PUBLICATIONS

Web page from school.fiskars.com/classroom/cool_tools/protactor/protactor.html, Nov. 2, 2000.

* cited by examiner

*Primary Examiner*—Christopher W. Fulton
*Assistant Examiner*—Mirellys Jagan
(74) *Attorney, Agent, or Firm*—Foley & Lardner

(57) ABSTRACT

A protractor comprising a frame and a lever arm coupled thereto. The frame includes a first substantially straight edge and an elongate track adjacent to the first edge. The lever arm includes a second substantially straight edge and a channel which mateably engages the track of the frame. The channel/track combination couples the lever arm to the frame and permits the lever arm to rotate about an axis substantially orthogonal to the first and second edges. The first and second edges intersect at a point allowing a user to describe an angle between the two edges.

19 Claims, 3 Drawing Sheets

PROTRACTOR

TECHNICAL FIELD

This invention relates generally to measuring instruments. More particularly, this invention relates to a protractor that permits a user to quickly and easily describe and define a wide variety of angular measurements.

BACKGROUND OF THE INVENTION

Protractors are well known and are used in a variety of fields and industries. For example, protractors are often used by school children who are learning how to define and a describe angular measures and to draw lines, shapes and figures that incorporate these measurements.

A typical prior art protractor 10 is shown in FIG. 1A. The prior art protractor 10 includes a horizontal member 12 coupled to a semi-circular member 14 that substantially circumscribes one side of the horizontal member 12. At the center of the horizontal member 12 is a center marking 16 which is used as a starting point for angular measurements. Along the outer edge 23 of the semi-circular member 14 are a plurality of radial markings 18 that are used to indicate the size, in degrees, of the particular angle relative to zero line 20 of the horizontal member 12.

Although such prior art protractors are useful, they have a number of shortcomings. For example, users in general, and particularly children, often wish to not only determine the magnitude of certain angles, but also wish to draw lines that will describe or define those angles. In the case of the prior art protractor shown in FIG. 1A the zero degree line 20 is offset from the inner edge 25 of the horizontal member 12 preventing the user from drawing one of the two lines necessary to describe an angle. Additionally, there is no second straight edge that can be used to describe the second line. For this reason, the user must use a second instrument, such as a ruler, to describe these lines. Because multiple instruments are required for this task, however, the accuracy of any angular definition can be diminished during the removal and/or placement of the instruments to be used in describing the angle. Additionally, the prior art protractor 10 shown in FIG. 1 typically has a very flat surface which can be especially difficult to grip and keep in a fixed position when making an angular measurement. This can be an especially difficult problem for young children, who have smaller hands and less developed coordination than an average adult.

A second prior art protractor is shown in FIG. 1B. The second prior art protractor 110 includes horizontal and semi-circular members 112 and 114 respectively, in a similar arrangement as shown in FIG. 1A. Similarly, the second prior art protractor 110 includes a center marking 116 and radial markings 118 along the outer edge 123 of the semi-circular member 114. The second prior art protractor 110 also includes a lever arm 125 that rotates about the center marking 116 via a pin-hole combination 127. The lever arm 125 serves as a guide that allows a user to more accurately define the angle being measured.

This arrangement also has disadvantages, however. For example, due to the pin-hole combination 127 of the second prior art protractor 110, the protractor 110 must have a zero line 120 that is offset from the inner edge 129 of the horizontal member 112. Because the zero-degree line is offset, a user cannot draw a complete and unbroken zero line without moving the protractor 110. Additionally, because the center marking 116 is offset from the inner edge 129 of the horizontal member 112, the user is unable to draw a second line along the lever arm 125 to the center marking 116 without moving the protractor.

SUMMARY OF THE INVENTION

It is therefore an object of the invention to provide a protractor that permits a user to define and describe a variety of angles and the starting and ending edges thereof with a single instrument.

It is a further object of this invention to provide an improved protractor that permits a user to accurately define a variety of angular measurements.

It is yet another object of this invention to provide a novel protractor that can easily be gripped by a user without affecting the accuracy of any angular measurements being made.

It is still another object of the invention to provide a novel protractor that enables a user to draw a complete angle and the point where the two outer lines of the angle intersect, wherein the corner created by the intersection of the two lines is always visible and accessible.

In accordance with these objects of the invention, an improved protractor is provided comprising a frame and an arm. The frame includes a first substantially straight edge and a circular track which is engaged with a concentric channel located on one side of the arm. The arm also includes at least one straight edge which is used to define one of the two boundaries of an angle. The combination of the track and channel permit the user to rotate the arm about an axis that is substantially orthogonal to both the arm and the frame, allowing the user to define a variety of angles between the edges on the frame and the arm. The arm is also provided with a gripping surface that allows the user to hold the protractor without affecting the measurement of the appropriate angle.

These and other objects, advantages and features of the invention, together with the organization and manner of operation thereof, will become apparent from the following detailed description when taken in conjunction with the accompanying drawings, wherein like elements have like numerals throughout the drawings described below.

DETAILED DESCRIPTION OF THE INVENTION

Figure 1A:
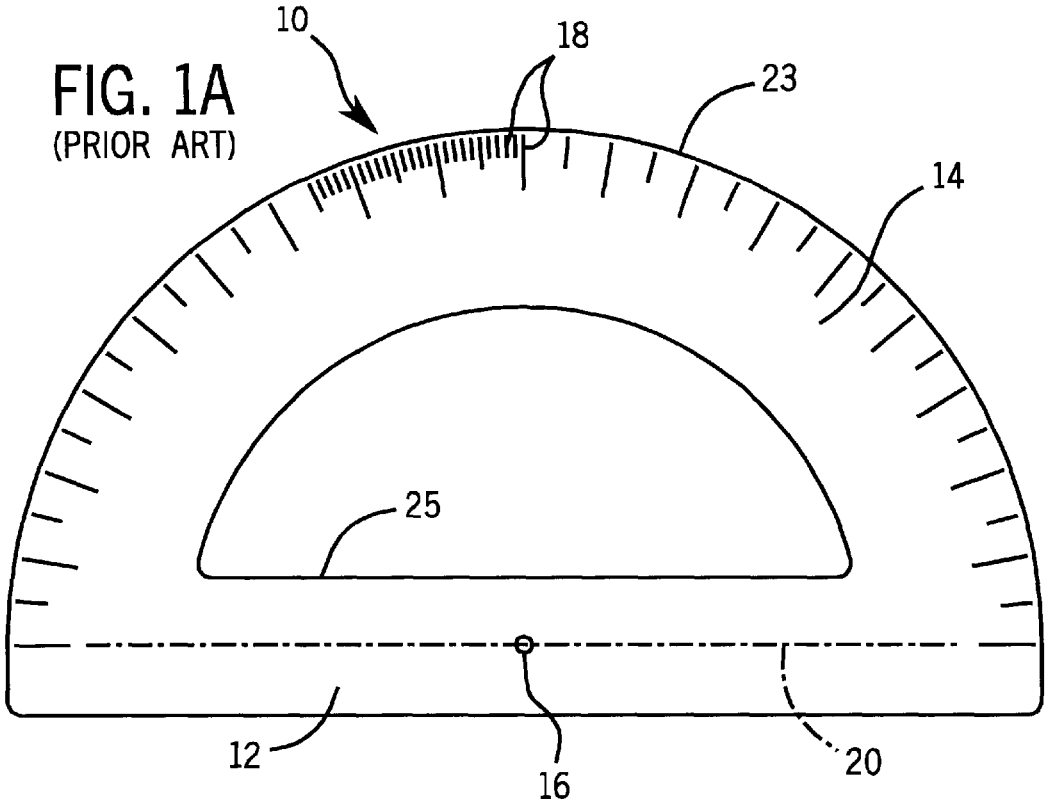
FIG. 1A (PRIOR ART)
FIG. 1A is a front view of a prior art protractor.
Figure 1B:
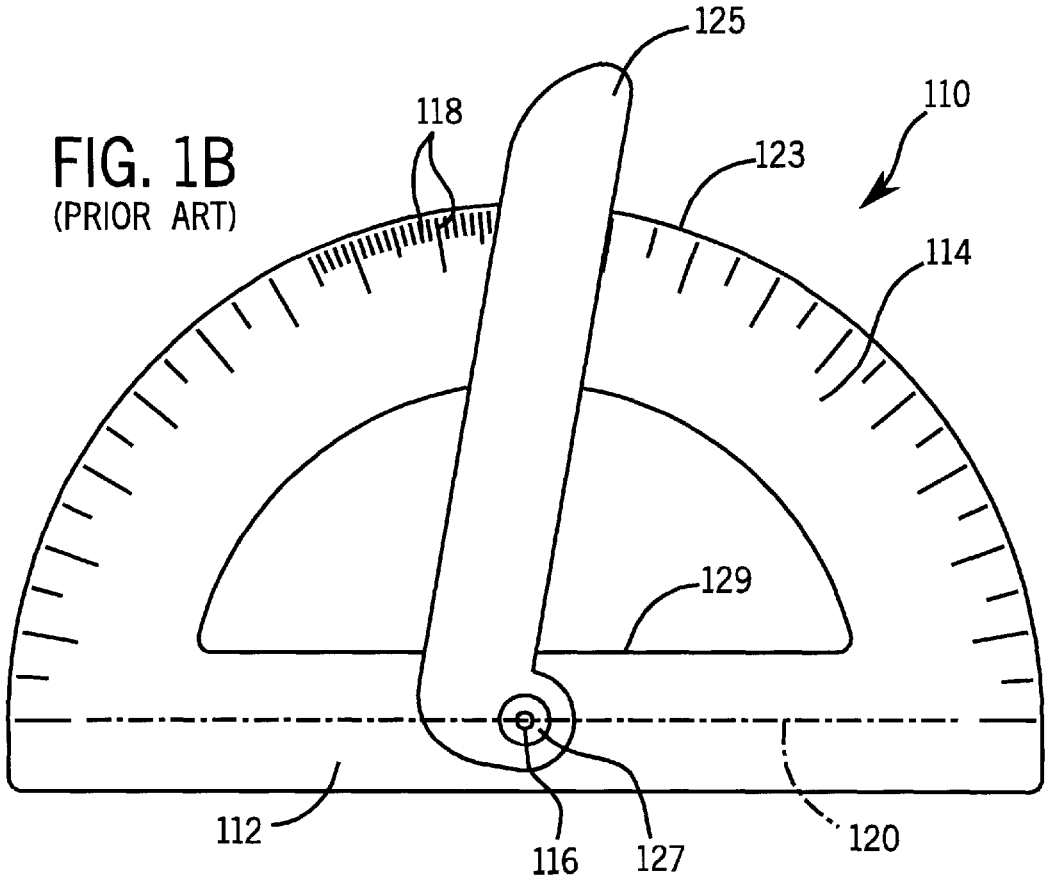
FIG. 1B (PRIOR ART)
FIG. 1B is a front view of a second prior art protractor.
Figure 2:
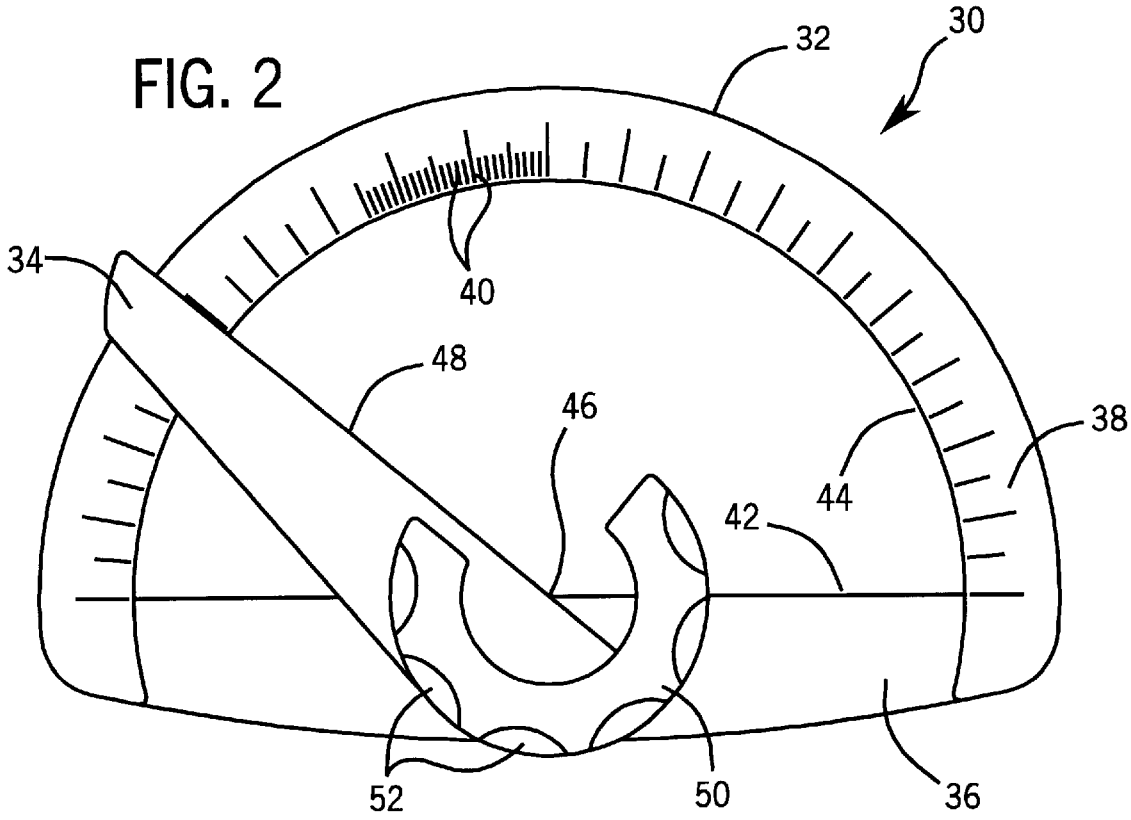
FIG. 2 is a front end view of a protractor according to one embodiment of the invention.

As shown in FIG. 2, a protractor 30 includes a frame 32 and a lever arm 34 coupled to the frame 32. The frame 32 includes a base portion 36 and a semi-circular portion 38. In one embodiment of the invention, the semi-circular portion 38 substantially circumscribes one side of the base portion 36. The semi-circular portion 38 includes an inner curved edge 44. In one embodiment of the invention, a series of gradations 40 are included along a curved edge 44 of the semi-circular portion 38. These gradations 40 identify particular angles to be measured by the protractor 30. The base portion 36 of the protractor includes a zero degree edge 42 that intersects the curved edge 44 of the semi-circular portion 38.

The lever arm 34 is coupled to the frame 32 and is rotatable about an axis that is substantially orthogonal to both the frame 32 and the lever arm 34. This axis runs substantially through the center point 46 of the zero degree edge of the base portion 36. The lever arm 34 includes a straight edge 48 that, combined with the zero degree edge 42 of the base portion 36, describe an angle. The straight edge 48 of the lever arm 34, in one embodiment of the invention, intersects the angular gradations 40 located on the semi-circular portion 38 of the frame 32, helping the user to precisely define an angle.

Also included on the lever arm 34 is a gripping surface 50 that allows the user to hold the protractor 30 without substantially interfering with any measurements that are being made. In one embodiment of the invention, the gripping surface 50 includes a plurality of depressions 52 that may correspond to the tips of a user's fingers to aid in the gripping process.

Figure 3:
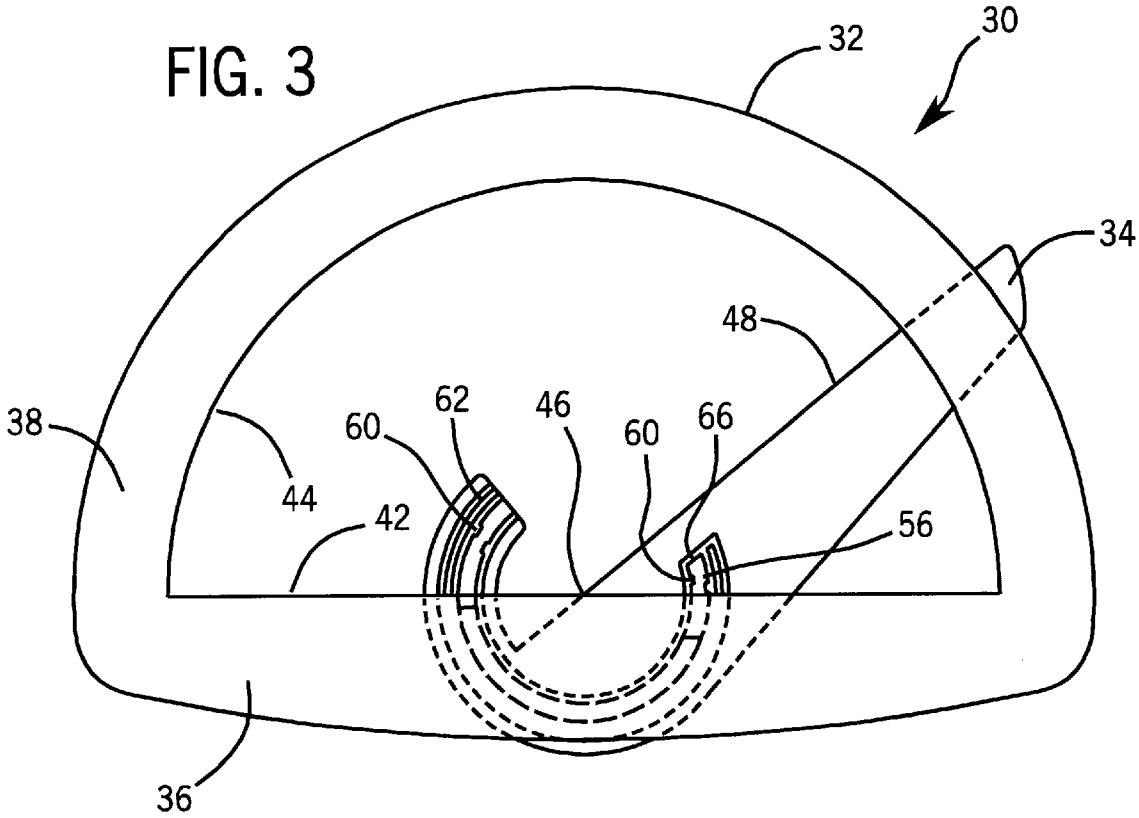
FIG. 3 is a back end view of the protractor of FIG. 2.
Figure 4:
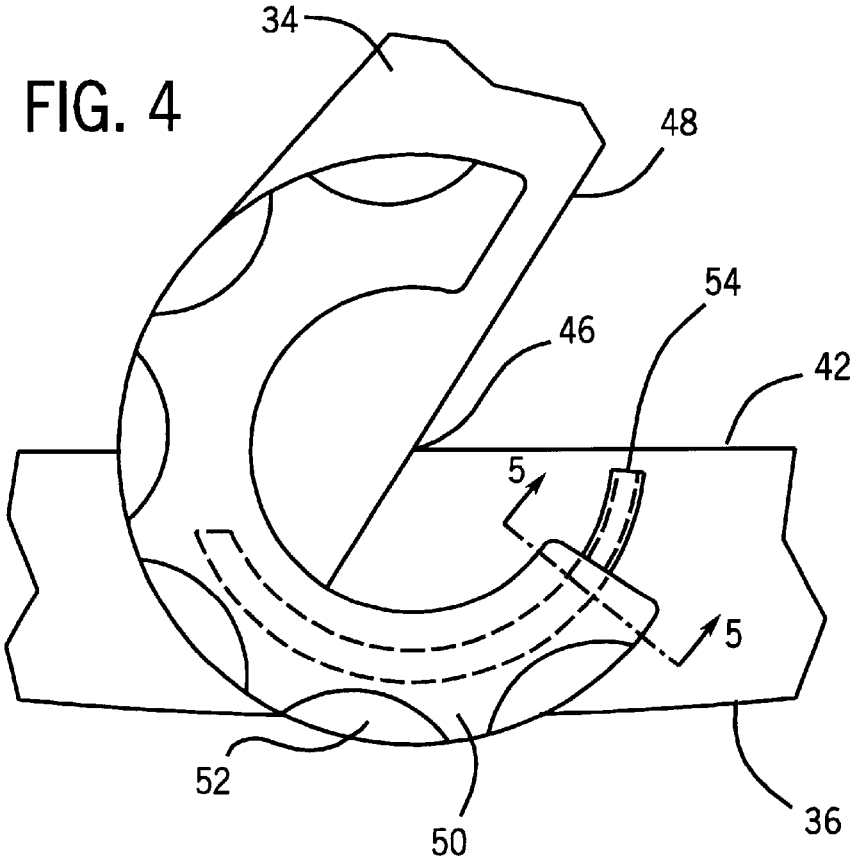
FIG. 4 is an enlarged view of the frame/lever arm combination of the protractor of FIG. 2.
Figure 5:
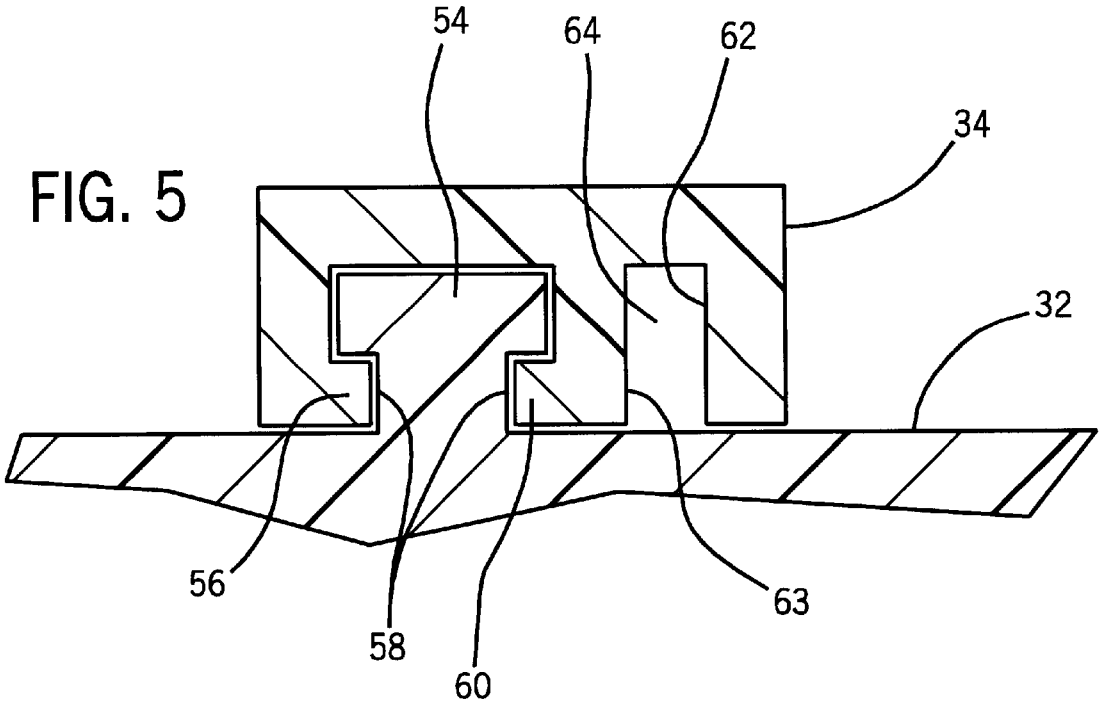
FIG. 5 is a sectional view taken along lines 5—5 of FIG. 4 showing the channel/track interaction.

As can be seen in FIGS. 3–5, the protractor frame 32 includes a track 54 (see FIGS. 4 & 5), and the lever arm 34 includes a mating channel 56 (see FIGS. 3 & 5) for rotatably coupling the frame 32 to the lever arm 34. In one embodiment of the invention, both the track 54 and the mating channel 56 are circularly shaped, allowing the lever arm 34 to rotate relative to the frame 32. As can be seen in FIG. 5, the track 54 includes a groove 58 on each side thereof, while the sides of the channel 56 include a plurality of protrusions 60 that mate with the groove 58. In one embodiment of the invention, the protrusions 60 are located intermittently on each side of the track 54. It is also possible, however, for there to be one or more continuous protrusions 60 along both sides of the track 54. The groove 58 and the protrusions 60 interlock to maintain the track 52 and the channel 56 in engagement with each other. The channel 56 can also include outer and inner walls 62 and 63 on one side of the channel 56, with a gap between the two walls 62 and 63. This additional spacing allows for the gripping surface 50 to be slightly wider, allowing the person to more easily handle the protractor 30. At one end of the channel 56 is a stopping surface 66 (see FIG. 3) which will contact the track 54 when the lever arm 34 reaches the limit of its rotatable path. This prevents the lever arm 34 from becoming disconnected from the frame 32. When the lever arm 34 is rotated to the maximum extent in the opposite direction, the straight edge 48 of the lever arm 34 will come into contact with the track 54, preventing additional movement or possible disconnection from the frame 32.

The operation of the protractor 30 is generally as follows. When a user desires to define or describe an angle, the user places the protractor 30 on a flat surface such as a piece of paper. The user then matches up the center point of the angle to be described with the center point 46 of the zero degree edge 42 of the protractor 30, while also matching up one of the two lines defining the angle with the zero degree edge 42 of the frame 32. The user then rotates the lever arm 34 relative to the frame 32 such that the straight edge 48 of the lever arm 34 intersects the point that, along with the center point 46, will define the second boundary line of the angle. The user is then able to determine the precise angle defined by the two lines by examining the gradations 40 along the semi-circular portion 38 of the frame 32. The user is also able to draw a line describing the angle through the use of the zero degree edge 42 of the frame 32 and the straight edge 48 of the lever arm 34. Because the lever arm 34 is capable of rotating relative to the frame 32, the user is able to quickly describe several different angles with a high degree of accuracy.

While several preferred embodiments have been shown and described, it is understood that changes and modifications can be made to the invention without departing from the invention's broader aspects. For example, the frame can be shaped in a variety of ways, with the semi-circular portion circumscribing varying portions of the base portion of the frame. Furthermore it is possible for the protractor not even to have a semi-circular portion at all, or for the semi-circular portion to substantially surround both sides of the base portion. The track and channel may also be interchanged such that the track is located on the lever arm and the channel on the frame while still achieving substantially the same result. Furthermore, it is possible to use other methods and means for rotatably coupling the lever arm to the frame. It is possible to allow the frame and lever arm to be separated from each other for storage or other reasons. Differently shaped or positioned gripping surfaces are possible on either the protractor frame or lever arm. Finally, the range of possible angles to be measured can be altered from anywhere between a few degrees to all 360 degrees of a circle, and the radial markings may be located on either the inner or outer edges of the semi-circular member. Thus, it is apparent that alternate embodiments are available to those skilled in the relevant art.

What is claimed is:

1. A protractor comprising:

a semicircular frame including a first substantially straight edge defining a zero degree line;

an arm including a second substantially straight edge; and means for rotatably coupling the arm to the frame, wherein the first and second substantially straight edges cooperate to form an angle therebetween, the user being able to mark the angle formed from the common point of the zero degree line and second substantially straight edge without moving the protractor, the common point remaining substantially stationary during rotation of the arm relative to the frame.

2. The protractor of claim 1, wherein the arm is securely fastened to the frame.

3. The protractor of claim 2, wherein the arm rotates about an axis substantially orthogonal to the first and second edges.

4. The protractor of claim 3, wherein the arm includes means for gripping the protractor.

5. The protractor of claim 4, wherein the frame includes a semi-circular edge substantially circumscribing the first straight edge.

6. The protractor of claim 3, wherein the angle defined by the first and second edges varies from about 0 to 180 degrees.

7. The protractor of claim 6, wherein the second straight edge intersects a semi-circular edge of the semi-circular frame.

8. A protractor for defining an angle, comprising:

a frame including a curved portion and a straight portion having a first substantially straight edge, the curved portion substantially circumscribing one side of the straight portion;

an arm rotatably connected to the straight portion along a curved track, the arm rotatable about an axis substantially orthogonal to the arm and the frame and including a second substantially straight edge, the first substantially straight edge intersecting the second substantially straight edge at a point which remains substantially stationary when the arm is rotated relative to the frame.

9. The protractor of claim 8, wherein the arm includes a channel for engaging the track.

10. The protractor of claim 8, wherein the angle defined by the intersection of the first and second substantially straight edges varies between about 0 and 180 degrees.

11. The protractor of claim 10, further including enabling means for marking the angle formed from the common point of the second substantially straight edge and a zero degree line defined by the first substantially straight edge without moving the protractor.

12. The protractor of claim 10, wherein the arm includes a projection on one side thereof for gripping the protractor.

13. The protractor of claim 12, wherein the arm extends beyond the curved portion of the frame.

14. A protractor, comprising:

a frame having a curved portion and a substantially straight portion, the straight portion including a first substantially straight edge and a circular track; and a lever arm including a second substantially straight edge and a channel engaging the track, the track coupling the lever arm to the frame and permitting the lever arm to rotate about an axis substantially orthogonal to the first and second edges, wherein the first and second edges intersect to define an angle therebetween, wherein the first and second substantially straight edges intersect at a point which remains substantially stationary during rotation of the lever arm.

15. The protractor of claim 14, wherein a user is able to mark the angle formed from the common point of the second substantially straight edge and a zero degree line defined by the first substantially straight edge without moving the protractor.

16. The protractor of claim 14, wherein the frame includes a curved edge defining a portion of a circle.

17. The protractor of claim 16, wherein the angle defined by the first and second substantially straight edges is adjustable between about 0 and 180 degrees.

18. The protractor of claim 17, wherein the curved edge defines about one half of a circle.

19. The protractor of claim 18, wherein the second substantially straight edge extends beyond a curved edge of the frame.

* * * * *